United States Patent [19]

Bright

[11] 4,038,841

[45] Aug. 2, 1977

[54] CLOTHES WASHER SPIN DELAY MECHANISM

[75] Inventor: James A. Bright, Dayton, Ohio

[73] Assignee: General Motors Corporation, Detroit, Mich.

[21] Appl. No.: 714,048

[22] Filed: Aug. 13, 1976

[51] Int. Cl.[2] ..... D06F 23/04; D06F 33/04

[52] U.S. Cl. ..... 68/12 R; 68/23.6

[58] Field of Search ..... 68/23 R, 23.4, 23.6, 68/23.7, 12 R

[56] References Cited

U.S. PATENT DOCUMENTS

| | | | |
|---|---|---|---|
| 2,869,344 | 1/1959 | Bochan | 68/23.7 X |
| 3,252,310 | 5/1966 | Brackman et al. | 68/23.6 |
| 3,267,703 | 8/1966 | Conrath et al. | 68/23.7 |
| 3,382,686 | 5/1968 | Hartley | 68/23 R |
| 3,739,942 | 6/1973 | Mercer et al. | 222/54 |
| 3,986,373 | 10/1976 | Goodlaxson | 68/23.7 |

*Primary Examiner*—Philip R. Coe
*Attorney, Agent, or Firm*—Edward P. Barthel

[57] ABSTRACT

An apparatus for the roller drive mechanism of a clothes washer which will delay spin tub rotation until a selected quantity of water has been pumped out of the tub. The spin delay apparatus includes a diaphragm movable in response to the water head in the tub. The diaphragm is operably connected to one end of an actuator lever arm which arm extends past its pivot for connection to an idler roller normally located between the drive and driven rollers in the drive mechanism. At the start of the spin cycle the actuator arm pivots the idler roller away from the drive roller until the water head indicates that the water has been pumped out of the tube to a predetermined level to obviate lint in the wash water from being left on the clothes.

1 Claim, 4 Drawing Figures

CLOTHES WASHER SPIN DELAY MECHANISM

This invention relates to a domestic clothes washer and more particularly to an improved roller drive mechanism for delaying the rotation of a washer spin tub until a predetermined amount of water has been pumped out of the tub.

In prior clothes washing art, agitating and spinning drive mechanisms are designed so that when the washer has finished the wash and/or rinse, the tub starts spinning at the same time the pump starts pumping out the water from the outer water container enclosing a spin tub. This results in the water leaving the tub being forced outwardly through the clothes resulting in the possibility of lint left in the water being deposited on the clothes. To alleviate this condition, the present invention provides a spin delay arrangement which prevents the spin tub from rotating until water has been pumped out of the tub to some predetermined level.

Accordingly, it is an object of this invention to provide an improved drive mechanism for a domestic clothes washer incorporating a spin delay apparatus to the washer agitating and spinning mechanism which does not require modification of the washer-timer apparatus.

Another object of the present invention is the provision of an improved spin delay assembly for a domestic washing machine roller drive mechanism wherein a spin delay is achieved by means of a water pressure responsive diaphragm in a control housing whereby the housing is in communication with a spin tub and movable responsive to pressure created by the water level in the tub. The spin delay mechanism includes a lever arm mounted on a support means for pivotal motion between a first axis, a spin roller bracket means pivotally connected to the lever arm adjacent one end thereof for rotatably relatively laterally movably supporting the spin roller for movement relative to a first axis, and wherein a rod operated by movement of the diaphragm between a spin delay and power transmitting position in response to increasing and decreasing pressure on the diaphragm. Means are provided for pivotally connecting the rod member to the lever arm about a second axis adjacent the other end of the arm; wherein an overcenter spring, one end of which is pivotally mounted about the arm's second axis and its other end being pivotally mounted on the support, normally biasing the rod into its power transmitting position such that the lever arm moves the spin roller into its power transmitting relationship between the spin driver and spin wheel. The pressure on said diaphragm is operative upon the tub being filled to a predetermined firstcleaning water level by the fill means to move the rod and diaphragm to their spin delay position and to retain same thereat. The biasing force of the spring is such that it progressively increases as the rod moves toward its power transmitting position upon the washer sequence control means enabling the initiation of the spin cycle and initiating the operation of the washer pump lowering the level of the water in the tub to a predetermined second lower level, whereby the spring overrides the pressure on the diaphragm to exert a progressively increasing snap action bias forcing the rod again into its power transmitting position to move the spring roller into positive nonchattering power transmitting relationship between the spin drive and spin wheel then initiating a delayed rotation of the tub in its spin cycle after the water level has been lowered to the second predetermined level.

Further objects and advantages of the present invention will be apparent from the following description, reference being had to the accompanying drawings, wherein a preferred embodiment of the present invention is clearly shown. In the Drawings.

Figure 3:
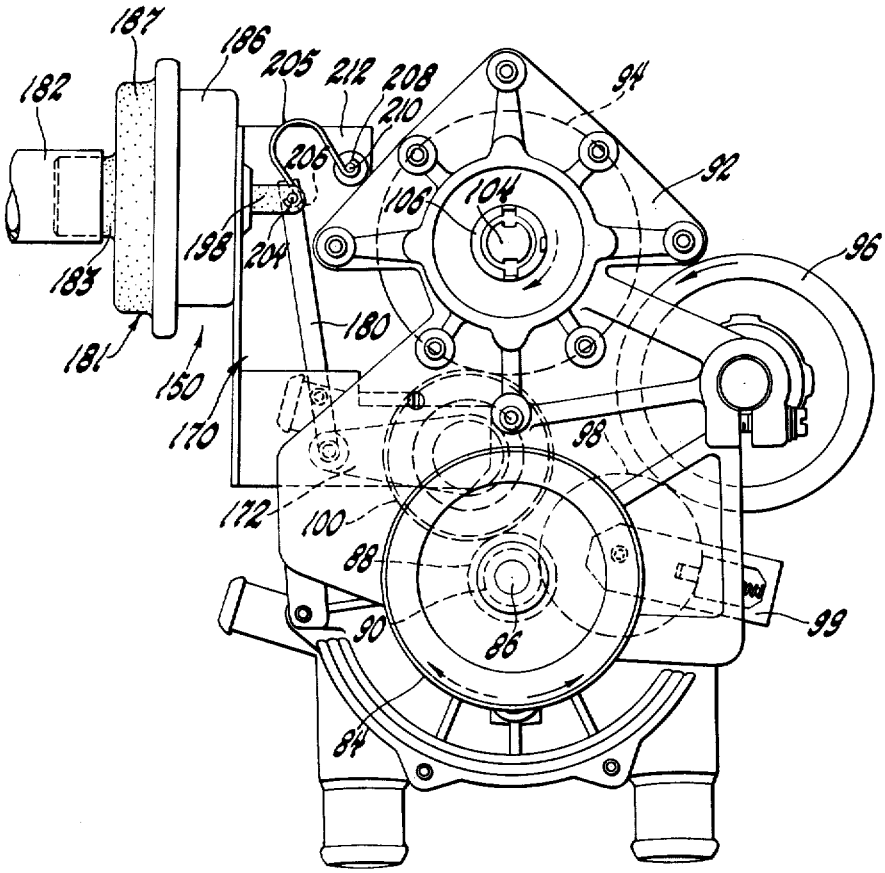
Figure 4:
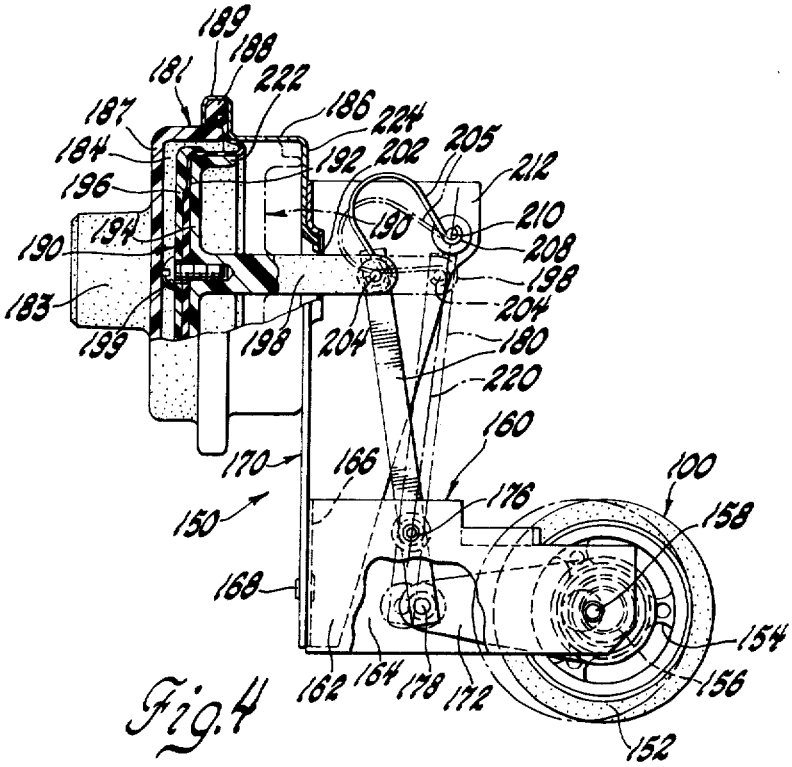

FIG. 3 is a horizontal elevational view of the roller drive spin delay mechanism with the spin drive roller shown in its engaged position; and FIG. 4 is a vertical elevational view with parts broken away of the spin delay roller drive and retractor assembly of the subject invention. As the environment of this invention and with reference to FIG. 1, a domestic top opening clothes washer is shown generally at 10. The washer includes a box-like sheet metal casing 12 having a top wall 14. The top wall has an access opening (not shown) through which clothes are loaded and unloaded.

The casing 12 is shown to enclose a nested tub assembly 24. The assembly includes an open top imperforate wall water container or outer tub 26 and a perforate wall spin basket or inner tube 28. Perforations are coextensive with the cylindrical side wall of the spin basket. As shown and described in the U.S. Pat. No. 3,702,069, issued Nov. 7, 1972 to Verlos G. Sharpe and assigned to the same assignee as the present application, an annular plastic subtop 30 is sealingly clamped to the open top of the water container 26. The subtop circumscribes the open top of the washer container and extends over a rim 33, forming the top opening of the spin basket 28 to define an access collar 36 between the top opening of the clothes washer cabinet and the top opening 33 of the spin basket.

The water container and, thus, the tub assembly 24 is mounted on a suspension system more fully taught in U.S. Pat. No. 3,493,118 granted Feb. 3, 1970. The tub assembly includes an agitator 44 which with the spin basket 28 is connected in movement effecting relationship to a drive mechanism or movement effecting means shown generally at 50. The drive mechanism is a roller-drive mechanism taught more fully in U.S. Pat. No. 3,087,321 granted Apr. 30, 1963. In general mechanism 50 may be operated through a reversible motor 52 in one manner to divertingly reciprocate or oscillate the agitator 44 for washing clothes in the tub assembly. When mechanism 50 is operated in another manner, the spin basket 28 is rotated with respect to the water container 26 for a centrifuging washing fluid from the clothes in the spin basket. A peripheral fill system is carried and supported on the annular plastic subtop 30. The underside of the subtop includes a pair of integral ribs 54, 56 which define a channel to receive a flexible fill tube 60 arranged around the top opening 33 of the spin basket and adapted to direct a series of fan-shaped sprays downwardly into the spin basket, as explained in the mentioned Sharpe patent.

Clean wash water is supplied to the tub assembly 24 by means of the peripheral fill tube 60 which is connected to a domestic water supply. For additional details regarding the peripheral fill system for clothes washer 10, reference may be had to U.S. Pat. No. 3,663,975.

Water supplied to the tub assembly is recirculated during a clothes washing operation. The recirculation system includes a sump 66 joined to and in communication with the bottom 68 of the water container 26. A recirculation pump 70 is supplied from the sump by means of a conduit 72 and returns water to the wash tub assembly 24 by means of the conduit 34. Conduit 34 terminates at 74 on the subtop 30 which leads to the removable lint filter drawer 35 through which the recirculating water flows on its way to the tub assembly.

Water is drained from the tub assembly through the sump 66. For this purpose, a drain pump 76 is connected to the sump by means of conduit 78 and to a remote drain by means of a conduit 80. The upper drain pump 76 and the lower recirculation pump 70 are joined into a stacked pump assembly shown in detail in the Sharpe patent.

Figure 1:
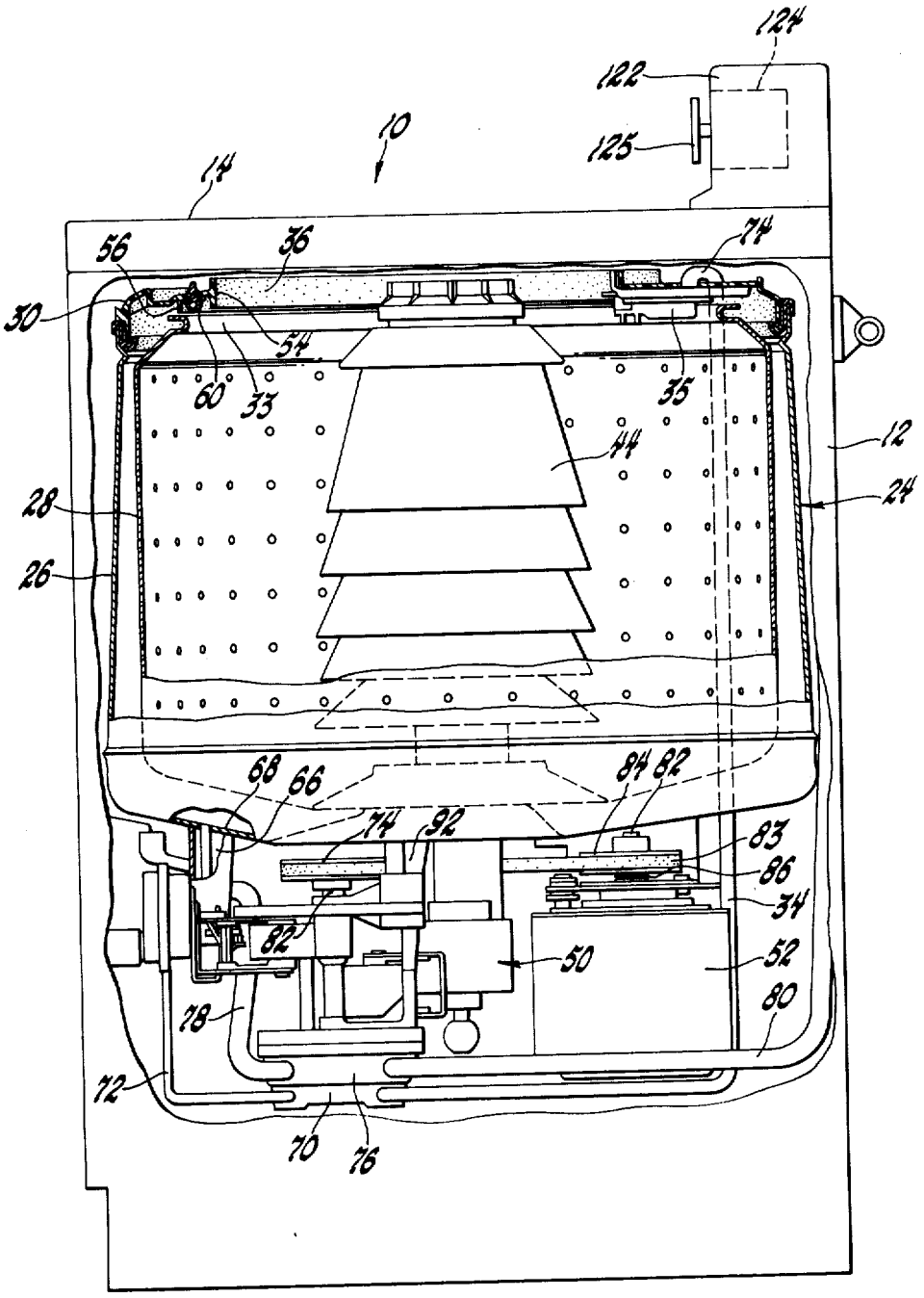
FIG. 1 is a side elevational view of a domestic clothes washing machine, partly in elevation and with parts broken away to show the drive mechanism in combination with the spin delay of this invention.
Figure 2:
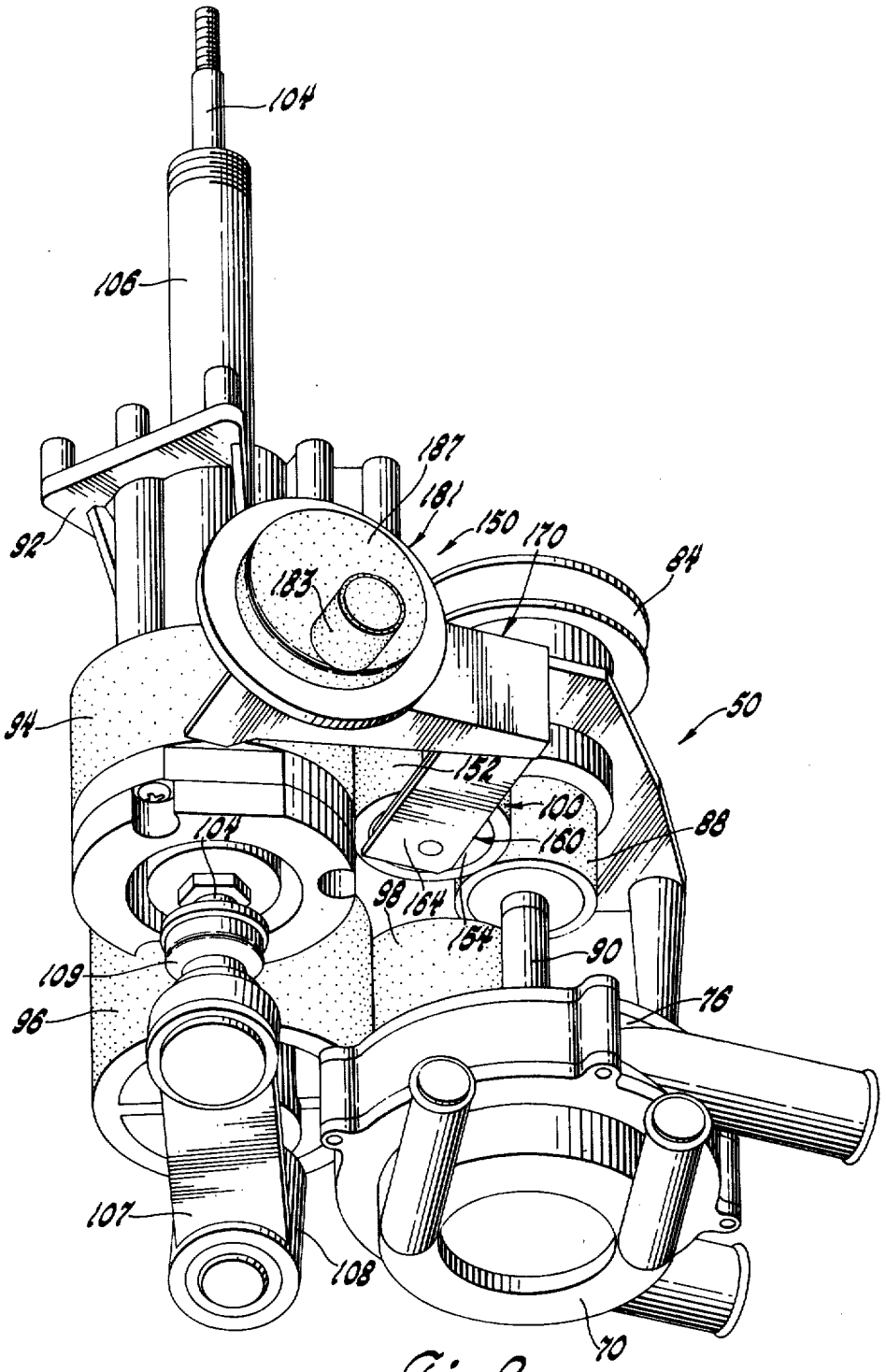
FIG. 2 is a perspective view of a completely preassembled roller drive agitating and spin delay mechanism in accordance with this invention.

Reference may now be had to FIGS. 1 and 2 for a general understanding of the components included in the agitate and spin mechanism 50. The mechanism includes a 1/3 h.p. split phase, single speed 1725 r.p.m. four-pole reversible motor 52. The motor 52 has a vertically extending power shaft 82 drivingly connected by belt 83 to pulley 84 on reversible power or drive shaft 86. Power shaft 86 has a spin portion or spin driver 88 and a reduced diameter agitate portion or agitate drive 90. The drain pump 76 is adapted through an impeller, as shown in U.S. Pat. No. 3,835,719to Bernard et al, in one direction of rotation to pump water from tub 26 through drain conduits 78 and 80. Suitable bearings (not shown) journal the power shaft in mechanism support 92.

On the same general plane as the spin driver 88 is a spin driven roller means or spin wheel 94 of the type taught in U.S. Pat. No. 3,314,257 to Foster, while an agitate wheel or agitate driven roller means 96 lies in the same plane as the agitate driver 90. Interposed between the agitate driver 90 and the agitate wheel 96 is agitate roller or idler 98, spring loaded and laterally floating on a retractor assembly 99 to make it self-energizing according to the concept of the U.S. Pat. No. 3,087,321 to Brucken. In the prior art mechanism, see the afore-mentioned Bernard et al U.S. Pat. No. 3,835,719, a self-energizing spin roller or idler 100 lies between the spin driver 88 and the spin wheel 94 supported on a retractor device shown in U.S. Pat. No. 3,287,942 to Brackman et al.

In general, operation of pulley 84 and power shaft 86 in the direction of the solid arrows (FIG. 3) will drive the agitate wheel 96 through the agitate roller 98 - this driving motion being translated into reciprocation of agitate shaft 104. Conversely, with the power shaft 86 reversed as shown by the dashed arrows, the prior art spin roller 100 will be drawn into wedging driving connection between the spin drive member 88 and the spin wheel 94 to rotate spin shaft 106. As seen in FIG. 2, agitate arm 107 includes a shaft and bearing 108 pressed onto one end while the opposite end of the agitate rocker arm 107 is connected to the agitate shaft 104 by means of agitate arm coupling 109.

With reference to FIG. 1, the clothes washer 10 includes a control housing assembly 122 positioned in the casing 12 with the casing 12 divided into a mechanism portion or compartment and the working compartment or water container chamber or outer tub 26. Conventional sequential operating timer means, shown generally at 124 on the control housing 122 is operable to selectively admit water through the supply conduit 34, to the spin tub 28 and to vertically reciprocate the agitator or pulsator 44.

Turning now to FIGS. 3 and 4, the spin delay assembly 150 of the present invention will now be described. The assembly 150 is comprised of the spin roller 100, which may be in the form of a polyurethane tire 152 molded onto an aluminum die cast insert 154 with a sintered bronze bushing 156 pressed into the insert to form a hub for the spin roller as shown, for example, in the Brackman et al U.S. Pat. No. 3,287,942.

For supporting the spin roller 100, the spin delay assembly includes a U-shaped roller support 160 having upper 162 and lower 164 support arms with a bite portion 166 suitably attached, as by rivets 168, to actuator mounting bracket 170. The U-shaped support is of the type shown in the aforementioned Brackman et al U.S. Pat. No. 3,287,942 wherein the diameter of the spin roller bushing 156 is oversized relative to spacer sleeve 158 to provide a sloppy fit.

Sandwiched between the support arms 162 and 164 are a pair of upper and lower pivot links, only the upper one being shown at 172, with the links 172 having socket portions for rotatably journaling the upper and lower ends of the bushing 156. In view thereof the socket portion of the pivot links as well as the spin roller journaled therein are permitted to shift in all lateral directions around the spacer sleeve.

The roller support 160 has a pair of aligned holes in its arms 162 and 164 for receiving the ends of a pivot pin 176 which pivotally supports a lever arm 180 adjacent its one end for pivotal motion about a first pivotal axis of the pin 176. As seen in FIG. 4, the pivot links 172 have their opposite ends formed with aligned apertures for receiving a link pivot pin 178.

It will be seen in FIGS. 2—3 that a spin tub liquid level sensor, generally indicated at 181, is shown in the present instance as water actuated. It is understood that other liquid level sensors could be utilized such as air actuated without departing from the scope of the invention. The sensor 181 senses the water level in the spin tub as represented by a predetermined head of water in the tub and transduces this information into a water pressure in water pressure tube 182 which is coupled to the drain sump at the bottom of the tub by a connector conduit. The water tube 182 is connected to stem 183 of the sensor to transmit the water pressure to the housing chamber 184. The sensor housing includes a hub-shaped annular metal body 186 having opposite open ends with a complementary shaped plastic cover 187 the peripheral flange 188 of which is fitted over the larger of the body open ends and secured by its rolled edge 189.

A piston member 190 includes a diaphragm 192 of flexible material, for example rubber, sandwiched between a base piston plate 194 and a cover piston plate 196 with the cover secured to integral piston stem rod 198 by screw 199. Accordingly, water pressure variations in the circuit effected by changes in the tub water level are applied as a force to move the piston diaphragm 190 toward the right as viewed in FIG. 4 to increase the chamber 184 and thereby move the piston rod 198 outwardly through aperture 202. The free end of rod 198 is apertured to receive a pivot pin 204 pivotally mounted in the other end of lever arm 180 whereby the rod 198 is pivotally connected to the lever arm about a second axis defined by pin 204.

Spring means in the form of an overcenter C-shaped leaf spring 205 has one curled end 206 pivotally mounted about the lever arm pivot pin 204 and its other curled end 208 pivotally mounted on a pin 210 fixed on side plate 212 of the mounting bracket 170. Thus, the C-spring normally biases the rod 198 into its power transmitting position whereby the lever arm 180 moves the spin roller 100 into its power transmitting relationship between the spin driver 88 and the spin wheel 94.

With reference to FIG. 4, it will be seen that the actuator spring 205 is operative such that whenever the outer tub is filled above a predetermined level, which in the disclosed form is a water head at or above 8 inches, the water pressure differential acting on the piston diaphragm member 190 is sufficient to move the same from the full line position illustrated in FIG. 4 to the dashed line position 190. This causes the push rod 198 to move axially to its dashed line location compressing and rotating the C-spring 205 to its dashed line position which is just short of being flexed or snapped into an "overcenter" state. Said differently, the pivot point 204 of the spring is moved to a position where the C-spring 205 exerts a minimal force on rod 198 in reaction to the water pressure force on the piston. In this way the lever arm of the spin delay is "cocked"and ready to be pivoted by spring 205 in a counterclockwise manner to move rod 198 into the sensor housing to the left upon a predetermined reduction in the height of the water level and a resultant lowering of the water pressure head acting on the piston cover plate 196.

In operation the user of a washing machine 10 provided with this invention may raise the lid and place within the spin tub 28 a quantity of fabrics or clothing. The user will select the desired cycle by positioning the timer 124 for such operation by its knob 125 to initiate a washing cycle. Water at the selected temperature will be selectively introduced to spin tub 28 and an agitating cycle will follow wherein operation of the motor 52 in the direction of the solid arrows shown in FIG. 3 will drive the agitate wheel 96 through the agitate roller 98 - this driving motion being translated into reciprocation through the rocker arm assembly 107.

The timer is connected to suitable valve means, as shown in U.S. Pat. No. 3,785,181 to Menk, to govern a predetermined clothes washing cycle including periods of wash water fill and rinse water fill. The timer 124 is also connected to the drive mechanism 50 to selectively reciprocate the agitator after periods of wash fill and rinse fill, respectively, for agitating articles to be washed while water is recirculated by pump 70. The timer connection with the drive mechanism 50 also effects a spinning of the tub 28 to centrifuge wash water and rinse water from the tub assembly 24. In the prior art during spinning, drain pump 76 operated in accordance with the timed cycle to pump centrifuged water from the outlet sump in the bottom of the water container 26 through conduits 72 and 80 to remove the centrifuged water to drain.

It was discovered, however, that this system may cause lint or other foreign material that had been removed from the clothing and suspended in the water, to be partially redeposited on the clothes during the initiation of the spin cycle before the rinse water has time to be removed from the water container 26. Accordingly, applicant's invention is effective to delay the spinning of tub 28 until the water level is reduced to a predetermined height in the sump which in the form shown is about one inch.

An important feature of the invention is that the operation of applicant's spin delay system is accomplished solely by mechanical action, without the necessity of any modification of the washer electrical timer control system. Thus, the disclosed spin delay mechanism can be readily incorporated in existing washing machines employing the roller drive pulsating mechanism by the customer or a service representative.

With the timer set in its Fill period, spin delay pressure responsive rod 198 is in its full line position and remains so as the water comes into the tub and fills the drain sump 66. As the water level rises to an elevation of about eight inches the water head in the sensor 181 chamber 184 exerts a pressure which is balanced with the force exerted by the C-spring. Upon the water level in the tub assembly continuing to rise a corresponding increase in the water pressure acts against the piston 190 to overcome a maximum force of the C-spring 205 which is applied against the piston push rod 198 in its full line engaged position. The water pressure moves the piston 190 to the right (FIG. 4) to its dashed line position cocking spring 205 to its dashed line position and disengaging the spin roller 100 from its driving position contacting spin wheel 94.

In its cocked position the center line of the lever arm established by fixed pivot pins 176 and fixed spring pivot pin 210 is shown in FIG. 4 by construction line 220. It will be noted that the movable spring pivot pin 204 in the cocked position approaches the construction line 220 but is prevented from piercing the plane line 220 by virtue of the piston base flange 222 contacting the bottom wall 224 of body 188. Thus, the flat C-spring is unable to move to an overcenter position so that the C-spring exerts minimal force holding the spin wheel in its retracted dash-line position.

With the timer set in its Spin period, the pump 70 is energized and drains the tub assembly 24 until the water level falls below an elevation of about one inch, whereupon the resulting minimal force of spring 205 overcomes the water pressure in chamber 184 and begins to move piston 190 to the left. The spring 205 and its pivot pins 204 and 210 are designed so that the spring 205 exerts a progressively increasing force providing a snap acting bias on the push rod 198 as it moves its piston to its top-dead-center or full line position. In this way the C-spring insures that the spin roller 100 is moved into its power transmitting positiion contacting spin wheel 94 with a positive non-chattering power transmitting relationship therebetween. This arrangement initiates a delayed rotation of the spin tub in its spin cycle after the water level has been lowered to a predetermined level, which is about one inch head in the disclosed form, to obviate foreign material such as sand or lint from being left on the clothes.

While the embodiment of the present invention as herein disclosed constitutes a preferred form, it is to be understood that other forms might be adopted.

I claim:

1. In a washing machine, a tub adapted to receive articles and contin cleaning water at various levels therein, rotatable spin shaft drivingly connected to said tub, water inlet fill means for supplying cleaning water to said tub, a pump operable for draining water from said tub, means for agitating the articles in the presence of the cleaning water, a support means, an electric motor, presettable sequence control means for conditioning said electric motor for effecting a predetermined series of operating cycles including concurrent spin and drain cycles for said tub, a roller drive mechanism for rotating said tub, said mechanism including, a spin wheel drivingly connected to said spin shaft, a power shaft drivingly connected to said motor and having a power shaft spin driver adjacent said spin wheel, means for self-energizingly positioning a spin roller in power transmitting relationship between said spin driver and said spin wheel in acordance with a signal from said sequence control means controlling motor rotation during said spin and drain cycles, the improvement wherein a lever arm mounted on said support for pivotal motion about a first axis, spin roller bracket means pivotally connected to said lever arm adjacent one end thereof for rotatively relatively laterally movably supporting said spin roller for movement relative to said first axis, a control housing including a fluid pressure responsive diaphragm therein in communication with said tub and movably responsive to pressure created by the water level in said tub, a rod operated by movement of said diaphragm between spin delay and power transmitting positions in response to increasing and decreasing pressure on said diaphragm; means pivotally connecting said rod member to said lever arm about a second axis adjacent the other end of said arm, spring means connected between said arm second axis and said support, said spring means normally biasing said rod into its power transmitting position whereby said lever arm moves said spin roller into said power transmitting relationship between said spin driver and said spin wheel, the fluid pressure on said diaphragm operative upon said tub being filled to a predetermined first cleaning water level by said fill means to move said rod and diaphragm to said spin delay position and to retain them in said spin delay position, the biasing force of said spring means progressively diminishing as said rod moves toward its spin delay position, said sequence control means enabling the initiation of said spin cycle and commencing the operation of said pump by said motor to lower the water level in said tub to a predetermined second level below said first level, whereby said spring means overrides the pressure on said diaphragm to exert a progressively increasing snap-acting bias forcing said rod again into its power transmitting position to move said spin roller into positive non-chattering power transmitting relationship between said spin driver and said spin wheel to initiate a delayed rotation of said tub in its spin cycle after the water level in said tub has been lowered to said predetermined second level.

* * * * *